US010041644B2

(12) United States Patent
Honda et al.

(10) Patent No.: US 10,041,644 B2
(45) Date of Patent: Aug. 7, 2018

(54) VEHICULAR LAMP

(71) Applicant: Koito Manufacturing Co., Ltd., Tokyo (JP)

(72) Inventors: Takahiko Honda, Shizuoka (JP); Takayuki Yagi, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 130 days.

(21) Appl. No.: 15/015,222

(22) Filed: Feb. 4, 2016

(65) Prior Publication Data

US 2016/0238206 A1 Aug. 18, 2016

(30) Foreign Application Priority Data

Feb. 13, 2015 (JP) ..... 2015-025948

(51) Int. Cl.

| | |
|---|---|
| ***F21S 8/10*** | (2006.01) |
| ***F21S 41/143*** | (2018.01) |
| ***F21S 41/147*** | (2018.01) |
| ***F21S 41/29*** | (2018.01) |
| ***F21S 41/255*** | (2018.01) |
| ***F21S 41/265*** | (2018.01) |
| *F21S 41/32* | (2018.01) |
| *F21S 45/47* | (2018.01) |

(52) U.S. Cl.

CPC ..... *F21S 48/1275* (2013.01); *F21S 41/143* (2018.01); *F21S 41/147* (2018.01); *F21S 41/255* (2018.01); *F21S 41/265* (2018.01); *F21S 41/295* (2018.01); *F21S 41/321* (2018.01); *F21S 45/47* (2018.01)

(58) Field of Classification Search

CPC ..... F21S 48/1275; F21S 48/1154; F21S 48/1159; F21S 48/1216; F21S 48/1258; F21S 48/1323; F21S 48/328; F21S 48/12; F21S 48/1208; F21S 48/1225; F21S 48/125; F21V 5/008

See application file for complete search history.

(56) References Cited

U.S. PATENT DOCUMENTS

| | | | | |
|---|---|---|---|---|
| 2007/0183168 | A1* | 8/2007 | Naganawa | B60Q 1/085 362/545 |
| 2013/0242589 | A1* | 9/2013 | Abe | F21S 48/1317 362/512 |
| 2014/0016343 | A1* | 1/2014 | Brendle | F21S 48/1159 362/518 |
| 2014/0321141 | A1* | 10/2014 | Bauer | F21S 48/1154 362/511 |

FOREIGN PATENT DOCUMENTS

| | | |
|---|---|---|
| JP | 2005-108554 A | 4/2005 |

* cited by examiner

*Primary Examiner* — Bao Q Truong
(74) *Attorney, Agent, or Firm* — Abelman, Frayne & Schwab

(57) ABSTRACT

The present disclosure provides a lamp unit including: a first lens that has a positive refractive power on a front surface and a rear surface thereof; a second lens that is positioned behind the first lens and has a plurality of positive refraction areas each having a positive refractive power; and a plurality of light sources that are arranged near focal points of the positive refractive areas. Thus, the light sources may be arranged to be spaced apart from each other.

13 Claims, 9 Drawing Sheets

VEHICULAR LAMP

CROSS-REFERENCE TO RELATED APPLICATIONS

This application is based on and claims priority from Japanese Patent Application No. 2015-025948, filed on Feb. 13, 2015, with the Japan Patent Office, the disclosure of which is incorporated herein in its entirety by reference.

TECHNICAL FIELD

The present disclosure relates to a vehicular lamp forming a plurality of light distributions.

BACKGROUND

A lamp of such a type includes a first lamp unit configured to mainly form a low beam and a second lamp unit configured to mainly form a high beam, in order to form two types of light distributions, e.g., a low beam light distribution and a high beam light distribution. With a recent demand for a compact size, a lamp that includes first and second light sources that are arranged above and below a plate-shape support member to share a projection lens so as to form a plurality of light distributions with a single lamp unit (see, e.g., Japanese Patent Laid-Open Publication No. 2005-108554).

SUMMARY

The constitution described in Japanese Patent Laid-Open Application No. 2005-108554 has a problem in that the light sources are close to each other so that the lamp may be easily filled with heat generated from the light sources.

The present disclosure has been proposed in order to solve the above-described problems and is to provide a vehicular lamp that forms a plurality of light distributions with a single lamp unit, of which light sources may be arranged to be spaced apart from each other.

In order to solve the above-described problem, an aspect of the present disclosure provides a vehicular lamp including: a first lens that has a positive refractive power on a front surface and a rear surface thereof; a second lens that is positioned behind the first lens and has a plurality of positive refraction areas each having a positive refraction power; and a plurality of light sources that are positioned at a plurality of locations, behind the second lens, respectively, which correspond to the plurality of the positive refraction areas of the second lens, respectively.

In other words, the second lens converges light from each of focal points of the plurality of the positive refraction areas to different areas of the first lens. The first lens converges light from the second lens and emits the light as parallel light.

According to this aspect, the light emitted from each of the focal points of the plurality of the positive refraction areas of the second lens is converged by the second lens to a positive refraction area, on which the light is incident, and allocated to different areas of the first lens. Then, the light is converged by the first lens to be emitted outward as parallel light.

In this aspect, since the light sources are arranged near the focal points of the positive refraction areas, the light sources may be arranged to be spaced apart from each other. In addition, a single lamp unit may form a plurality of light distributions depending on the number of the positive refraction areas of the rear second lens.

The second lens may be formed as an integrated body including a plurality of front convex lenses that are integrally formed, and a front surface of the first lens may be formed by a substantially convex surface with a vertically and transversely continuous curvature.

The positive refraction areas of the second lens may have an upper area and a lower area.

The light sources may be a low beam light source positioned corresponding to the upper area and a high beam light source positioned corresponding to the lower area.

Each of the first lens and the second lenses may have a flange and both of the flange of the first lens and the flange of the second lens be positioned and fixed to a support member of the light sources through lens support members configured to fix both the flanges.

According to the present disclosure, it is possible to provide a vehicular lamp, in which a single lamp unit forms a plurality of light distributions, and light sources may be arranged to be spaced apart from each other.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Hereinafter, exemplary embodiments of the present disclosure will be described with reference to the accompanying drawings.

First Exemplary Embodiment

Figure 1:
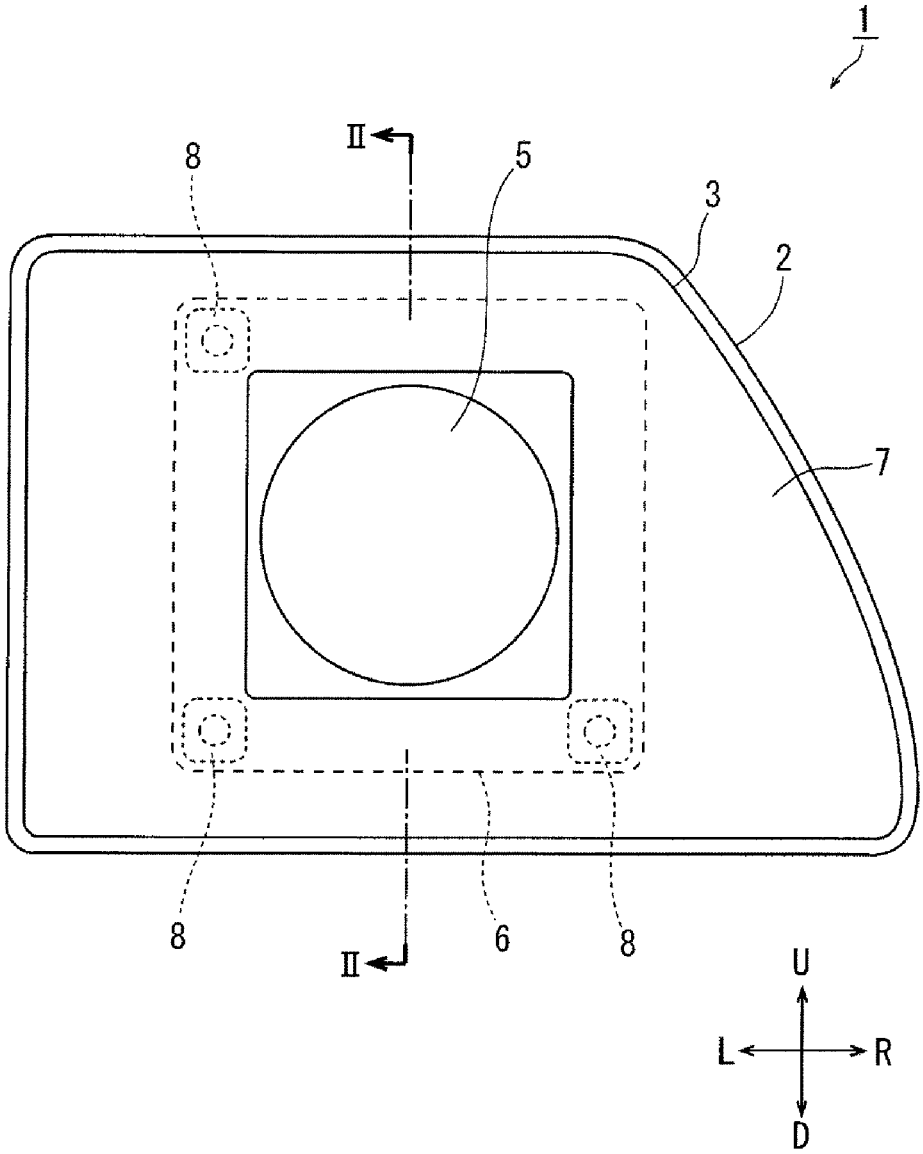
FIG. 1 is a front view of a lamp according to a first exemplary embodiment.
Figure 2:
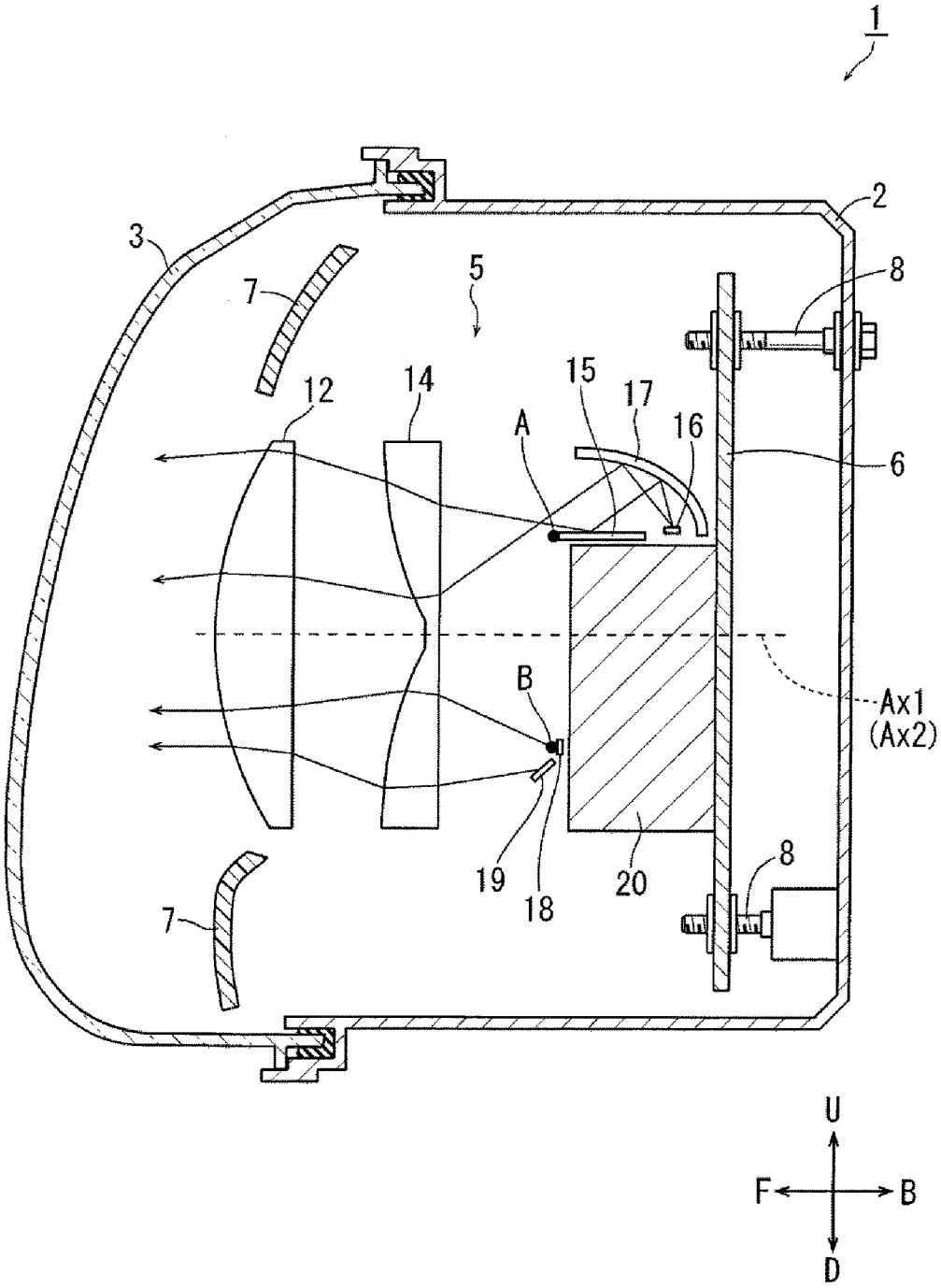
FIG. 2 is a vertical cross-sectional view of the lamp according to the first exemplary embodiment.

FIG. 1 is a front view of a lamp 1 according to a first exemplary embodiment. FIG. 2 is a vertical cross-sectional view of the lamp 1 according to the first exemplary embodiment (a cross-sectional view taken along the line II-II of FIG. 1).

The lamp 1 is a head lamp installed in either of the left side or the right side of a front part of a vehicle. Arrow L-R indicates a left-and-right direction when the lamp 1 is viewed from the front side, arrow U-D indicates an up-and-down direction when the lamp 1 is viewed from the front side, and arrow F-B indicates a front-and-back direction when the lamp 1 is viewed from the front side. The lamp 1 includes a lamp chamber that is defined by a box-shaped lamp body 2 having an opening, and a front cover 3 attached to the opening. The front cover is formed of a transparent resin, glass, or the like.

In the lamp chamber, a lamp unit 5, a lamp bracket 6, and an extension 7 are arranged. The extension 7 is positioned in front of the lamp unit 5 and has an opening to permit light emitted from the lamp unit 5 to travel toward the front side of the lamp. The lamp bracket 6 has four (4) corners, of which three corners are fixed to the lamp body 2 by aiming screws 8, and enables an optical axis of the lamp unit 5 to be adjusted vertically and transversely.

The lamp unit 5 includes a first lens 12, a second lens 14, a Lo light source 16 and a Lo reflector 17 for a low-beam, a shade 15, a Hi light source 18 and a Hi reflector 19 for a high-beam, and a heat sink 20, in this order from the front side. The heat sink 20 is a metal block fabricated by aluminum die-casting and serves as a support member of the components of the lamp unit 5. A heat radiation pin (not illustrated) is formed on the rear surface of the heat sink 20 so as to enable heat from the Lo light source 16 and the Hi light source 18 to be radiated into the space in the lamp chamber. The heat sink 20 is fixed to the front surface of the lamp bracket 6.

Figure 3A:
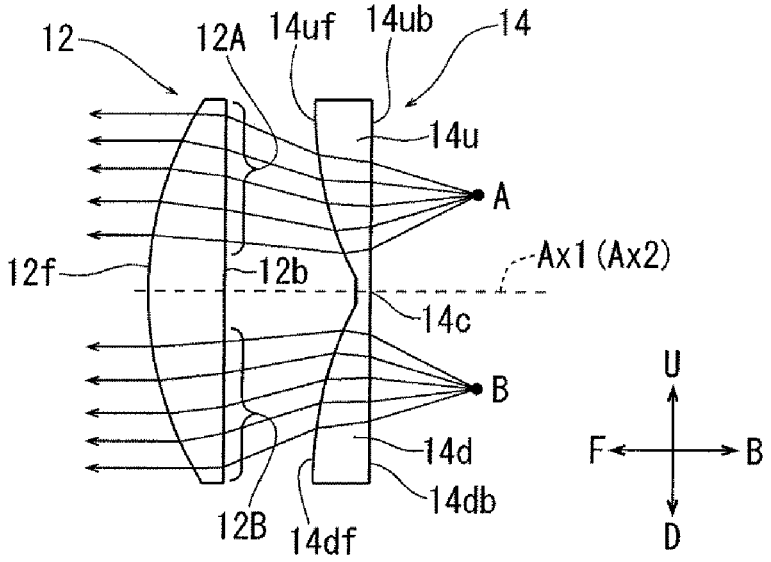
FIGS. 3A and 3B are views illustrating light beams formed by a lamp unit according to the first exemplary embodiment.
Figure 3B:
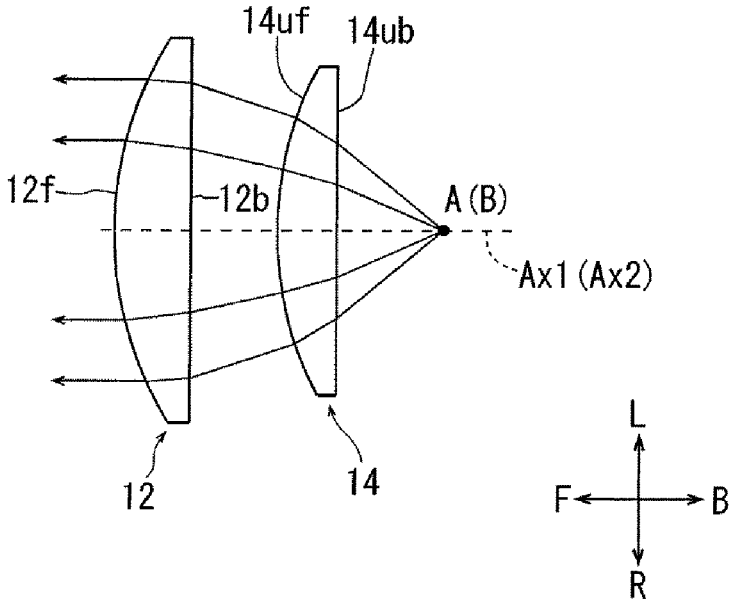

First, descriptions will be made on the two lenses, which form a principal part of the present disclosure, i.e., the first and second lenses 12 and 14. FIGS. 3A and 3B are views illustrating light beams formed by the lamp unit 5 according to the first exemplary embodiment. FIG. 3A is a vertical cross-sectional view of the first and second lenses 12 and 14 (a cross-sectional view in the up-and-down direction). FIG. 3B is a horizontal cross-sectional view of the first and second lenses 12 and 14 (a cross-sectional view in the left-and-right direction). The arrows in FIGS. 3A and 3B represent light beams.

The first lens 12 is a plano-convex lens having a front surface 12*f* with a vertically and transversely continuous curvature and a flat rear surface 12*b*. The first lens 12 has a positive refractive power to converge light incident from the rear surface 12*b* and emit the light from the front surface 12*f* as parallel light. Meanwhile, the front surface 12*f* may have different curvatures in the up-and-down direction and in the left-and-right direction (non-rotary symmetric).

The second lens 14 is positioned behind the first lens 12. The second lens 14 includes two (2) positive refraction areas of an upper area 14*u* and a lower area 14*d*, which have a positive refractive power to converge the light incident from the rear surface and emit the light from the front surface. Each of the upper area 14*u* and the lower area 14*d* has a shape obtained by dividing a plano-convex lens into two portions. The upper area 14*u* has a convex front surface 14*uf* that has a vertically and transversely continuous curvature such that the upper end of the upper area 14*u* becomes the thickest, and a flat rear surface 14*ub*. The lower area 14*d* has a convex front surface 14*df* that has a vertically and transversely continuous curvature such that the lower end of the lower area 14*d* becomes the thickest, and a flat rear surface 14*db*. Accordingly, in the second lens 14, the light incident on the upper area 14*u* is subjected to a refractive power that converses the light upwardly, and the light incident on the lower area 14*d* is subjected to a refractive power that converges the light downwardly. The upper area 14*u* and the lower area 14*d* are interconnected by a connecting portion 14*c* to form an integrated lens. The connecting portion 14*c* may be formed in a flat plate shape having no lens characteristic, but may have a ridge with a discontinuous curvature.

The second lens 14 has upper and lower rear focal points, which are symmetric with each other about the optical axis Ax1 of the first lens 12. That is, the second lens 14 has a rear focal point A of the upper area 14*u* and a rear focal point B of the lower area 14*d* (hereinafter, simply referred to as the "focal point A" and the "focal point B"). The second lens 14 converges, in its upper area 14*u*, the light emitted from the focal point A to an upper area 12A of the first lens 12 and converges, in its lower area 14*d*, the light emitted from the focal point B to a lower area 12B of the first lens 12 in order to upwardly and downwardly allocate the lights emitted from the focal points A and B.

The first lens 12 also converges the light incident from the upper area 12A to emit the light toward the front side of the lamp as parallel light, and also converges the light incident from the lower area 12B to emit the light toward the front side of the lamp as parallel light. In addition, light source images of the focal points A and B formed on a rear focal plane of the first lens 12 are projected to the front side of the lamp as reversed images.

Subsequently, the periphery of the light sources will be described, but the light sources are not specifically limited with respect to their types in the present disclosure. Besides the light emitting diodes to be described below, an incandescent lamp, a discharge lamp, or other diodes may be used for the light sources. In addition, the following descriptions relate to an appropriate example in a case where it is intended to form two types of light distributions, for example, a low beam and a high beam by using the first and second lenses 12 and 14 that form a principal part of the present disclosure.

As illustrated in FIG. 2, the Lo light source 16 is a white light emitting diode having a rectangular light emitting surface. The Lo light source 16 is positioned behind the focal point A in correspondence with the upper area 14*u*, and fixed to the top surface of the heat sink 20 with the light emitting surface facing upward. The Lo reflector 17 has a curved surface of a generally elliptical shape, and is fixed to the top surface of the heat sink 20 such that the first focal point is located at the light emission center of the Lo light source 16. The reflector 17 reflects the light emitted from the Lo light source 16 toward the front side of the lamp. The shade 15 has an upper end edge in a shape capable of partially shading the light that is emitted from the Lo light source 16 and reflected by the Lo reflector 17. The shade 15 is integrated with the heat sink 20 such that the upper end edge is located at the focal point A.

The Hi light source 18 may include eleven (11) white light emitting diodes each having a rectangular light emitting surface. The light emitting diodes in the Hi light source 18 are arranged on the left and right sides of the focal point B at equal intervals in correspondence with the lower area 14*d*, and fixed to the front surface of the heat sink 20 with the light emitting surfaces facing forward. Each white light emitting diode in the Hi light source 18 is independently controlled to be turned ON/OFF by an ON/OFF control circuit (not illustrated) and a light distribution control ECU (not illustrated). The Hi reflector 19 has a flat surface or a parabolic curved surface and is fixed to the front surface of the heat sink 20 to extend below the array of the white light emitting diodes in the Hi light source 18. The Hi reflector 19 reflects the light emitted from the light source 18 toward the front side of the lamp.

Figure 4:
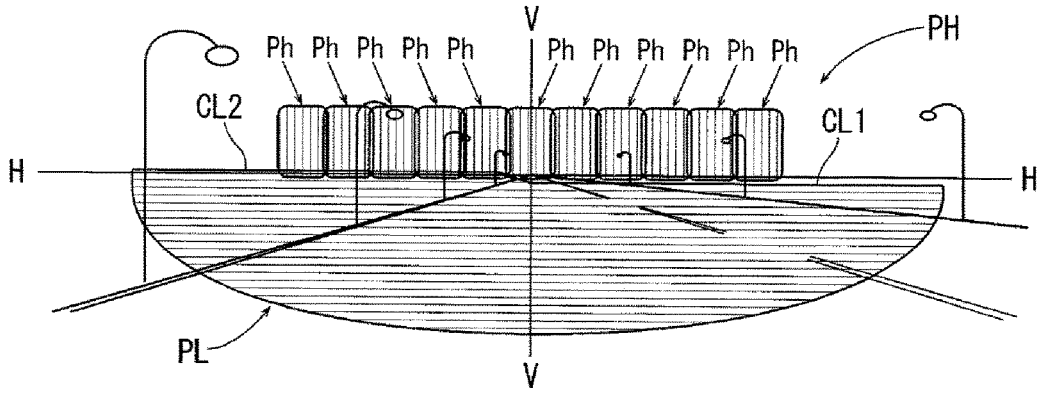
FIG. 4 is a view illustrating light distribution patterns obtained by the lamp according to the first exemplary embodiment

Descriptions will be made on light distributions formed by the lamp unit 5 having the configuration as described above. FIG. 4 is a view illustrating light distribution patterns obtained by the lamp 1 according to the first exemplary embodiment. FIG. 4 represents a virtual vertical screen placed at a position 25 m away from the front side of a vehicle, and illustrates a case where both the Lo light source 16 and the Hi light source 18 are turned ON.

When the light source 16 is turned ON, a low beam light distribution pattern PL having cutoff lines CL1 and CL2 is formed in an area mainly below the line H-H of the virtual vertical screen. Since the shape of the low beam light distribution pattern PL is well-known, descriptions thereof will be omitted. When all the white light emitting diodes in the Hi light source 18 are turned ON, a high beam light distribution pattern PH is formed by the combination of eleven (11) rectangular segments Ph, which are projection images of the white light emitting diodes in the Hi light source 18, in an area mainly above the line H-H of the virtual vertical screen. The white light emitting diodes in the Hi light source 18 may be independently turned ON/OFF as described above. Thus, although not illustrated, the high beam light distribution pattern PH may form an adaptive driving beam (ADB) to turn some of the segments Ph in FIG. 4 OFF, when the light distribution control ECU detects the presence of other objects from, for example, an oncoming vehicle sensor, a pedestrian sensor or the like mounted in, for example, a vehicle.

Figure 5:
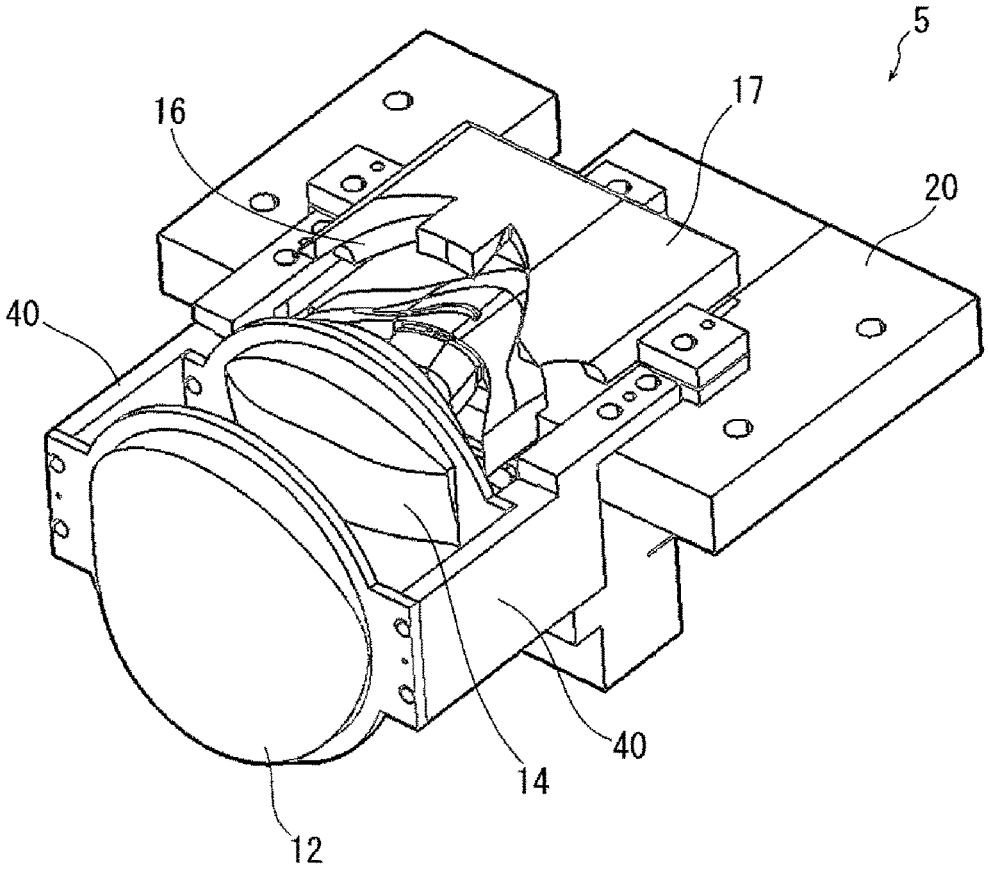
FIG. 5 is a perspective view of the lamp unit according to the first exemplary embodiment.
Figure 6:
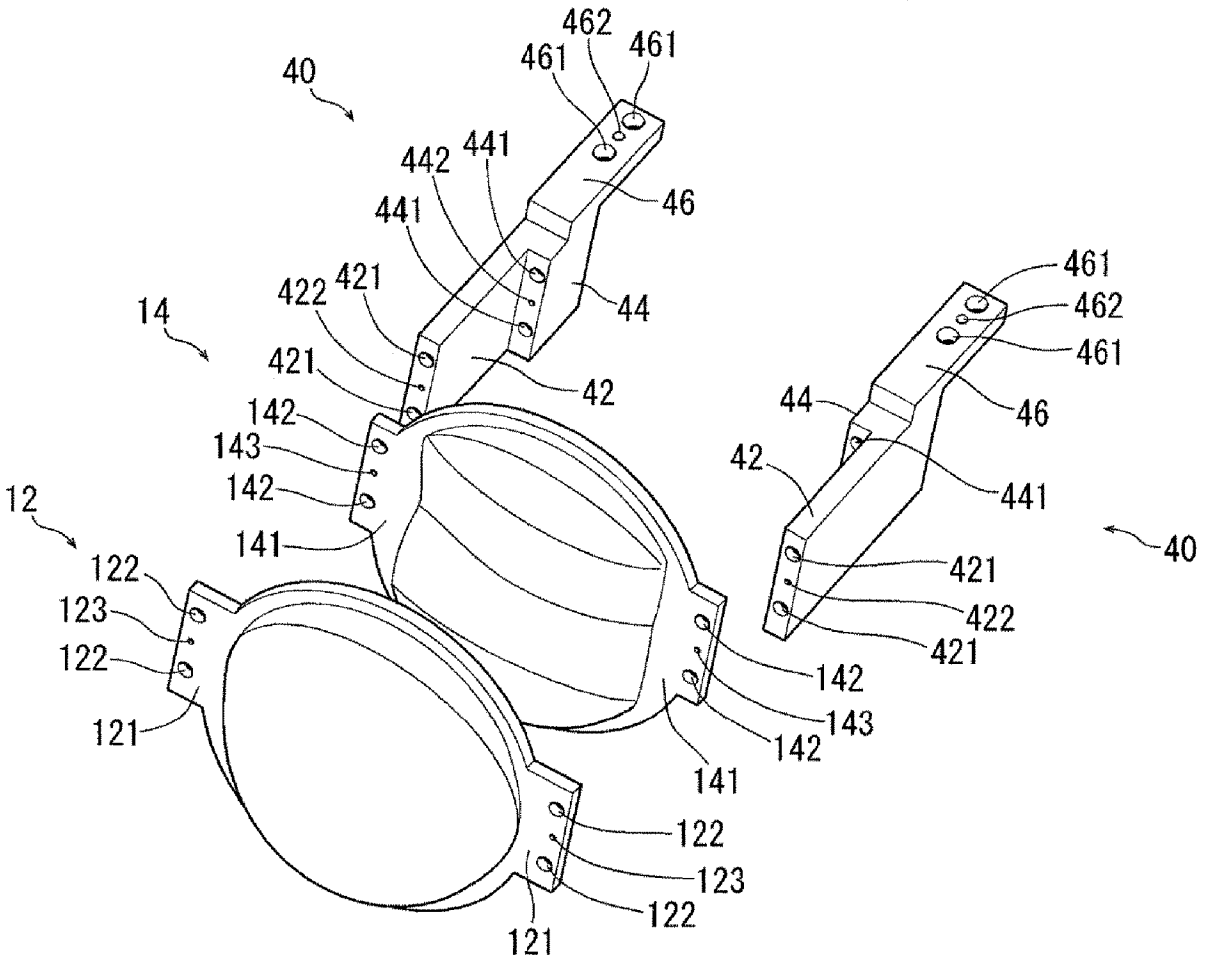
FIG. 6 is an exploded view of a part of the lamp unit according to the first exemplary embodiment.

Subsequently, descriptions will be made regarding an exemplary fixing form of the two (2) lenses 12 and 14 to appropriately implement the function of the lamp unit 5. FIG. 5 is a perspective view of the lamp unit 5 according to the first exemplary embodiment, and FIG. 6 is an exploded perspective view of part of the lamp unit 5 according to the first exemplary embodiment.

A pair of flanges 121 are integrally formed with the first lens 12, in which the flanges 121 extend from left and right peripheral edges of the first lens 12 toward the left and right directions, respectively. Each of the flanges 121 has through holes 122 opened at two points, in which the vertical distance between two points in one flange 121 is equal to that in the other flange 121. A positioning hole 123 is formed between the through holes 122 in each of the flanges 121.

Similarly, a pair of flanges 141 are integrally formed with the second lens 14, in which the flanges 141 extend from left and right peripheral edges of the first lens 14 toward the left and right directions, respectively. Each of the flanges 141 has through holes 142 opened at two points in which the vertical distance between two points in one flange 141 is equal to that in the other flange 141. A positioning hole 143 is formed between the through holes 142 in each of the flanges 141. The length of the flanges 141 in the left and right directions is shorter than that of the flanges 121 of the first lens 12.

The two lenses 12 and 14 are positioned and fixed to the heat sink 20 by a pair of lens support members 40. Each of the lens support members 40 has a first abutment portion 42, a second abutment portion 44, and an arm portion 46.

The second abutment portion 44 has a flat plate shape, and includes fitting holes 441 on the vertical front end surface thereof which are in line with the through holes 142 of the second lens 14. A positioning pin 442 is formed at a position corresponding to the positioning hole 123 between the fitting holes 441. The second lens 14 is first positioned by the positioning hole 123 and the positioning pin 442, and then, fixed to the vertical front end surface by screw sets (not illustrated) through the through holes 142 and the fitting holes 441.

The first abutment portion 42 is positioned outside the second abutment portion 44 and has a flat plate shape extending forwardly from the second abutment portion 44. The first abutment portion 2 includes fitting holes 421 on the vertical front end surface thereof which are in line with the through holes 122 of the first lens 12. A positioning pin 422 is formed at a position corresponding to the positioning hole 123 between the fitting holes 421. The first lens 12 is first positioned by the positioning hole 123 and the positioning pin 422, and then, fixed to the vertical front end surface by screw sets (not illustrated) through the through holes 122 and the fitting holes 421.

The arm portion 46 extends rearwardly from the top end surface of the first and second abutment portions 42 and 44, and screw-clamped to the heat sink 20 using fitting holes 461 formed at two points of the rear side of the arm portion 46 and a positioning hole 462 to be engaged with a positioning pin (not illustrated) protruding upwardly from the heat sink 20. As described above, each of the first lens 12 and the second lens 14 has, on the outer peripheral edge thereof, a pair of flat flanges 121 or 141 each having a flat plate shape and the lens support members 40 have stepped portions, of which the number corresponds to the number of the lenses, in the front-and-back direction. Each of the first lens 12 and the second lens 14 is fixed and positioned as follows: the flanges 121 of the first lens 12 are brought into contact with and fixed to the vertical front end surfaces of the outermost stepped portions (the first abutment portions 42), and, inside the flanges 121, the flanges 141 of the second lens 14 are brought into contact with and fixed to the vertical front end surfaces of stepped portions (the second abutment portions 44) which are formed to have a length to be shorter than the outermost stepped portions in the front-and-back direction. Then, the lens support members 40 are fixed to the heat sink 20, to which the light sources 16 and 18 are fixed, such that the light sources 16 and 18, the first lens 12, and the second lens 14 are positioned.

Meanwhile, the lengths of the arm portions 45 and the first and second abutment portions 42 and 44 in the front-and-back direction are properly designed based on the positions of the focal points of the first and second lenses 12 and 14.

As described above, according to the lamp unit 5, light emitted from the focal points A and B of the second lens 14 is converged to the upper and lower areas 14*u* and 14*d* of the second lens 14, respectively, to be allocated to the upper and lower areas 12A and 12B of the first lens 12, respectively, and further converged by the first lens 12 to be projected as parallel light.

When the light sources are arranged at effective positions in the lamp unit 5, the light sources are arranged near the rear focal points A and B of the upper and lower areas 14*u* and 14*d*. Thus, in the lamp unit 5, the light sources may be arranged to be spaced apart from each other.

In addition, while the lamp unit 5 is a single lamp unit configured to project the Lo light source 16 and the Hi light source 18 by using a single projection lens (the first lens 12), the lamp unit 5 may form two types of light distributions, i.e., the low beam light distribution pattern PL formed via the upper area 14*u* of the second lens 14 and the high beam light distribution pattern PH formed via the lower area 14*d* of the second lens 14.

In addition, since the two lenses 12 and 14 are arranged in the front-and-back direction, the lamp looks like a single-bulb lamp that has only the first lens 12 arranged at the foremost position from the front side of the lamp and has a continuous surface, when the lamp is turned OFF (see FIG. 1). Thus, the lamp is also suitable in view of design of a lamp. Further, due to the refractive power of the foremost first lens 12, the structure behind the first lens 12 is hardly conspicuous.

In addition, since the two lenses 12 and 14 are arranged in the front-and-back direction, the refractive power may be dispersed to the lenses so that each of the lenses may be formed to be thin. Thus, the time required for injection molding of the lenses may be reduced.

In addition, since the flanges 121 and 141 are formed on the first and second lenses 12 and 14 and the first and second lenses 12 and 14 are positioned and fixed to the heat sink 20, which is a support member of the light sources 16 and 18, by the lens support members 40, the first and second lenses 12 and 14 may be fixed in a state where the central axis of the first lens 12 (i.e., the optical axis Ax1) and the central axis of the second lens 14 (the axis passing the center of the entire second lens 14, and in the present exemplary embodiment, the axis Ax2, about which the rear focal point A of the upper area 14*u* and the rear focal point B of the lower area 14*d* are vertically symmetric with each other) are coaxially aligned to each other.

Second Exemplary Embodiment

Figure 7:
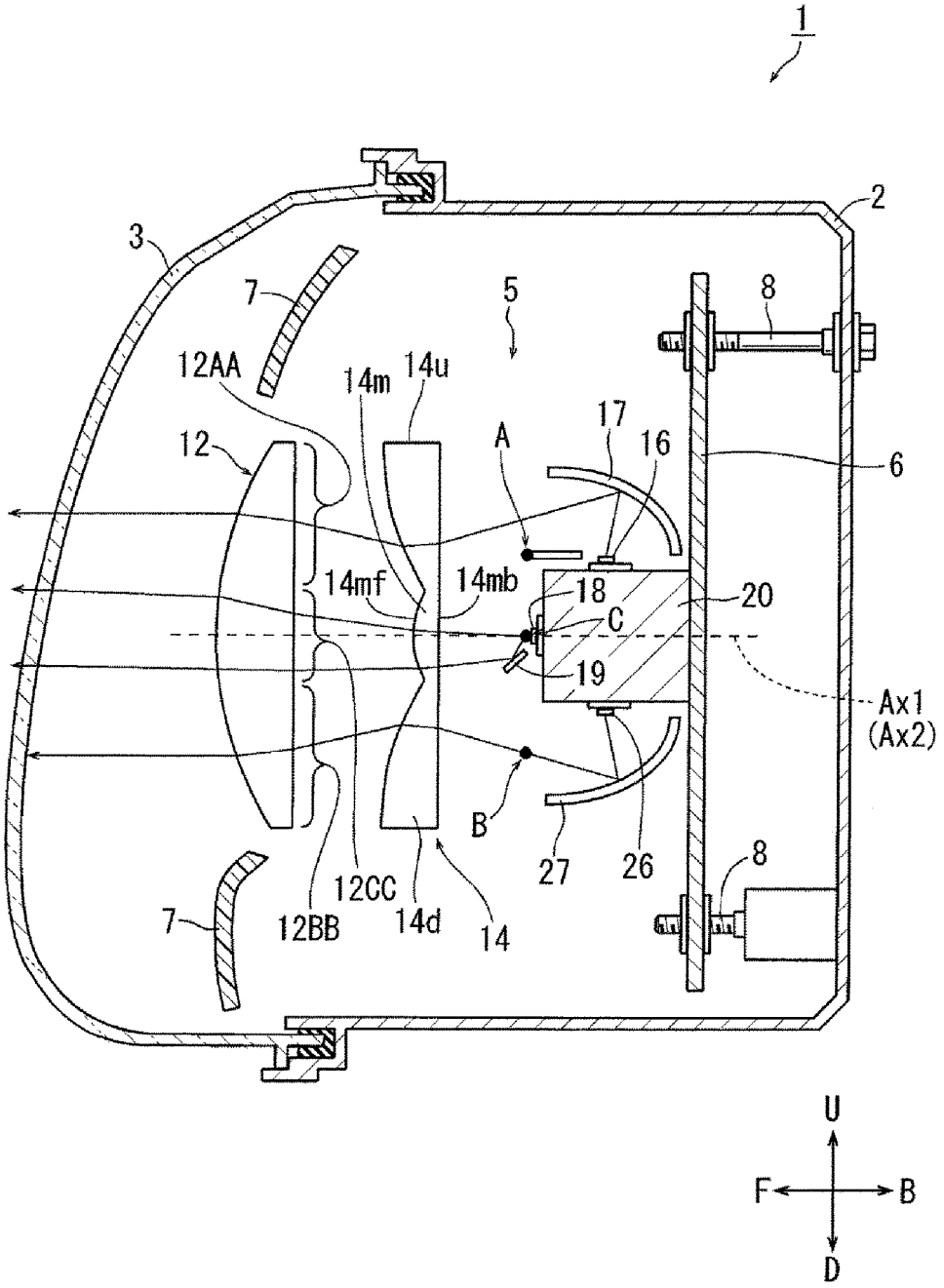
FIG. 7 is a vertical cross-sectional view of a lamp according to a second exemplary embodiment.

The lamp unit 5 according to the present disclosure may form a larger number of light distributions depending on the number of the positive refraction areas of the rear second lens 14. Descriptions will be made on this configuration. FIG. 7 is a vertical cross-sectional view of a lamp 1 according to a second exemplary embodiment. Meanwhile, components, which are identical to the components of the first exemplary embodiment, will be denoted by the same reference numerals, and descriptions thereof will be omitted.

The first lens 12 is identical to that of the first exemplary embodiment.

The second lens 14 has three (3) positive refraction areas that have a positive refractive power to converge light incident from the rear surface, and emit the light from the front surface, i.e., the upper area 14*u*, a middle area 14*m*, and the lower area 14*d*. The upper area 14*u* and the lower area 14*d* are identical to those of the first exemplary embodiment. The middle area 14*m* is a plano-convex lens having a convex front surface 14*mf* with a vertically and transversely continuous curvature and a flat rear surface 14*mb*. The middle area 14*m* converges light incident from the rear surface 14*mb*, and emits the light from the front surface 14*mf*. In the present exemplary embodiment, the central axis Ax2 of the second lens 14 corresponds to the optical axis of the middle area 14*m*. The focal point C of the middle area 14*m* appears on the optical axis Ax1 of the first lens 12, and the focal point A of the upper area 14*u* and the focal point B of the lower area 14*d* appear above and below the optical axis Ax1, respectively, to be symmetric with each other. The upper area 14*u* and the lower area 14*d* are connected by the middle area 14*m*, thereby being formed as an integrated lens.

In the present exemplary embodiment, the light, which is incident on the upper area 14*u* of the second lens 14 from the focal point A and, is converged to the upper area 12AA of the first lens 12, light, which is incident on the lower area 14*d* of the second lens 14 from the focal point B, is converged to the lower area 12BB of the first lens 12, and light, which is incident on the middle area 14*m* of the second lens 14 from the focal point C, is converged to the central area 12CC of the first lens 12, such that the light is allocated to the upper area, the lower area, and the central area of the first lens 12 and emitted from the first lens 12 toward the front side of the lamp as parallel light.

Descriptions will be made on an exemplary periphery of light sources suitable for the lamp unit 5 in the case where the present exemplary embodiment is adopted. The descriptions made hereinafter relate to an example of a case in which it is intended to form three types of light distributions, e.g., a low beam, a high beam, and an additional beam.

The Lo light source 16 that forms the low beam, the Lo reflector 17 and the shade 15 are identical to those of the first exemplary embodiment, and the fixing positions thereof are also identical to those of the first exemplary embodiment.

While the Hi light source 18 that forms the high beam and the Hi reflector 19 are also identical to those of the first exemplary embodiment, and the fixing positions thereof are also identical to those of the first exemplary embodiment, the white light emitting diodes in the Hi light source 18 are arranged on the left and right sides of the focal point C of the middle area 14*m*.

The present exemplary embodiment further includes an additional light source 26 and a reflector 27 for the additional light source 26. The additional light source 26 is, for example, a white light emitting diode having a rectangular light emitting surface. The additional light source 26 is positioned behind the focal point B of the lower area 14*d*, and fixed to the bottom surface of the heat sink 20 with the light emitting surface facing downward. The additional reflector 27 has a generally elliptical curved surface, and is fixed to the bottom surface of the heat sink 20 such that the first focal point is located at the light emission center of the additional light source 26. The additional reflector 27 reflects light emitted from the additional light source 26 toward the front side of the lamp.

Figure 8:
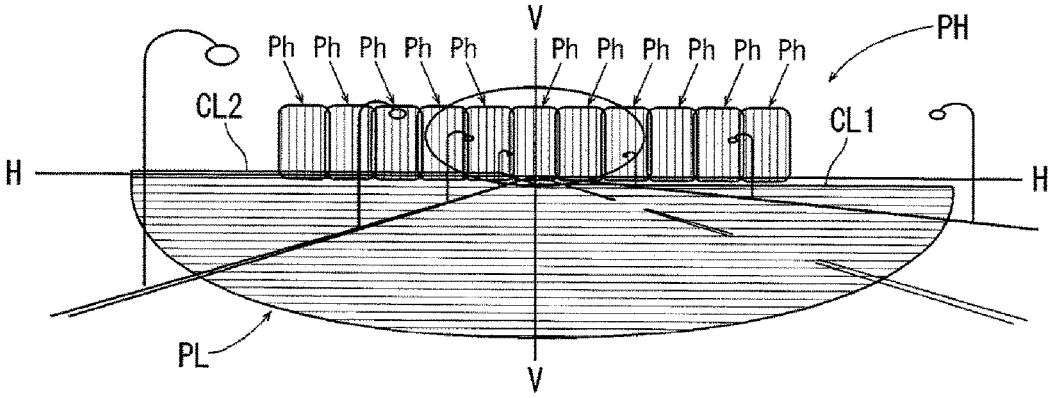
FIG. 8 is a view illustrating light distribution patterns obtained by the lamp according to the second exemplary embodiment.

Light distributions formed by the lamp unit 5 will be described. FIG. 8 is a view illustrating light distribution patterns obtained by the lamp according to the second exemplary embodiment. FIG. 8 also represents a virtual vertical screen placed at a position 25 m away from the front side of a vehicle, and illustrates a case where all the Lo light source 16, the Hi light source 18, and the additional light source 26 are turned ON.

In the present exemplary embodiment, in addition to the low beam light distribution pattern PL by turning ON the Lo light source 16 and the high beam light distribution pattern PH by turning ON the Hi light source 19, an additional high beam light distribution pattern PH2 of an oval shape is formed around the cross point of the line H-H and the line V-V by turning ON the additional light source 26 in order to improve visibility of a distant place. As described above, the lamp unit 5 is one lamp unit that projects the Lo light source 16, the Hi light source 18 and the additional light source 26 by means of a single projection lens (the first lens 12), and may form three types of light distributions, i.e., the low beam light distribution pattern PL formed via the upper area 14*u*, the high beam light distribution pattern PL formed via the lower area 14*d*, and the additional high beam light distribution pattern PH2 formed via the middle area 14*m*.

As described above, the present disclosure may form light distribution patterns as many as the number of the positive refraction areas formed in the rear second lens 14. In the above-described exemplary embodiments, descriptions have been made on the examples in which the lamp unit 5 is applied to a head lamp that forms a low beam and a high beam. However, the lamp unit 5 may be applied to a tail lamp that forms a plurality of light distributions such as, for example, a turn signal lamp and a stop lamp.

(Modifications)

Figure 9A:
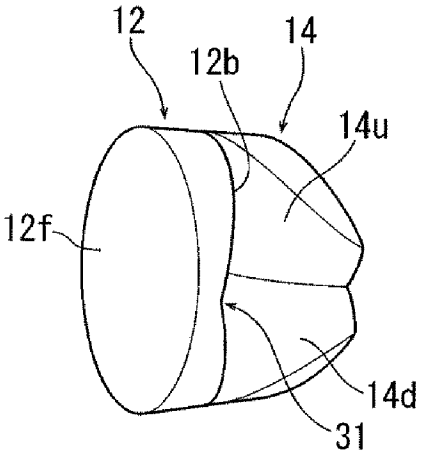
FIGS. 9A, 9B and 9C are modifications of a lens pertaining to implementation of the present disclosure.
Figure 9B:
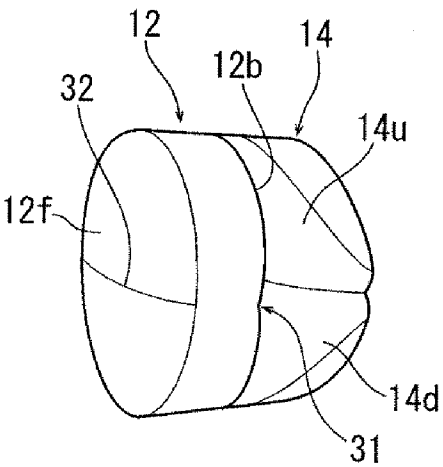
Figure 9C:
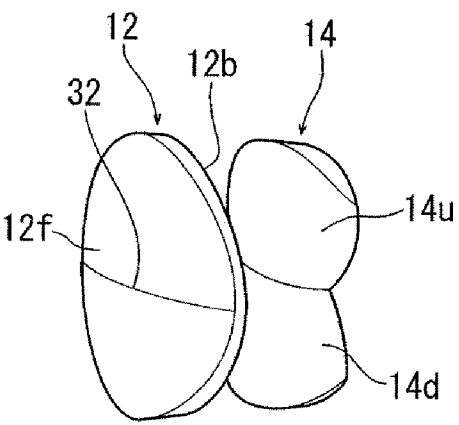

The first lens 12 and the second lens 14 may be subject to the modifications described hereinafter. FIGS. 9A to 9C illustrate modifications of the lenses according to the present disclosure. The modification will be described based on the first exemplary embodiment. The components, which are identical to those of the first exemplary embodiment, will be denoted by the same reference numerals, and descriptions thereof will be omitted.

In FIG. 9A, the rear surface 12*b* of the first lens 12 has a continuously curved V-shaped concave portion 31, which is recessed in a V-shape at the center of the vertical direction of the first lens 12 toward the front surface 12*f*. Accordingly, the light from the focal point A of the upper area 14*u* of the second lens 14 and the light from the focal point B of the lower area 14*d* of the second lens 14 may be more easily allocated to the upper and lower areas of the rear surface 12*b*. Further, since the rear surface 12*b* is curved, the structure behind the first lens 12 is more hardly conspicuous.

In FIG. 9B, the front surface 12*f* of the first lens 12 has a slightly concave portion 32, which is slightly recessed in a V-shape at the center of the vertical direction of the first lens 12 toward the rear surface 12*b*. The rear surface 12*b* has the V-shaped concave portion 31 as described above. Accordingly, the light from the focal point A of the upper area 14*u* of the second lens 14 and the light from the focal point B of the lower area 14*d* of the second lens 14 may also be easily allocated to the upper and lower areas of the front surface 12*f*. As described above, the front surface 12*f* of the first lens 12 may have a convex surface with a vertically and transversely continuous curvature, on which a concave portion is partially formed. In this case, the slightly concave portion 32 of the front surface 12*f* of the first lens 12 has a negative refractive power since diffusion occurs in the slight concave portion 32. However, the case is construed as being included in the scope of the present disclosure since the entire first lens 12 has a positive refractive power for convergence.

In FIG. 9C, the first lens 12 is formed as a biconvex lens. The rear surface 12*b* has a convex surface with a vertically and transversely continuous curvature, and the front surface 12*f* has the slightly concave portion 32 as described above. Meanwhile, the curvature of the second lens 14 may be properly determined according to the first lens 12 of FIGS. 9A to 9C.

With respect to other modifications, the second lens 14 may not be formed as one lens (an integrated lens). That is, a lens having the function of the upper area 14*u* and a lens having the function of the lower area 14*d* may be individually positioned and fixed.

In addition, the second lens 14 may have a plurality of positive refraction areas in the transverse direction or in the vertical and transverse directions, in addition to the plurality of the positive refraction areas in the vertical direction as in the above-described exemplary embodiments.

In addition, a third lens, a fourth lens, and the subsequent lenses, which have the same function as that of the second lens 14, may be arranged behind the second lens 14, so as to further disperse the refractive power of each of the lenses.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A vehicular lamp comprising:

a first lens that has a positive refractive power on a front surface and a rear surface thereof;

a second lens that is positioned behind the first lens and has an upper area having a first refractive power that converges light incident on the upper area upwardly and a lower area having a second refractive power that converges light incident on the lower area downwardly; and first and second light sources that are arranged at two locations, behind the second lens, respectively, which correspond to the upper area and the lower area of the second lens, respectively.

2. The vehicular lamp of claim 1, wherein the second lens converges light from each of focal points of the upper area and the lower area to different areas of the first lens, and the first lens converges the light from the second lens and emits the light as parallel light.

3. The vehicular lamp of claim 1, wherein the second lens is formed as an integrated lens including two front convex lenses that are integrally formed, and the front surface of the first lens is formed by a substantially convex surface with a vertically and transversely continuous curvature.

4. The vehicular lamp of claim 2, wherein the second lens is formed as an integrated lens including two front convex lenses that are integrally formed, and the front surface of the first lens is formed by a substantially convex surface with a vertically and transversely continuous curvature.

5. The vehicular lamp of claim 1, wherein the first and second light sources are a low beam light source positioned to correspond to the upper area and a high beam light source positioned to correspond to the lower area.

6. The vehicular lamp of claim 1, wherein each of the first lens and the second lens has a flange, and is positioned and fixed to a support member of the first and second light sources through a lens support member configured to fix both the flange of the first lens and the flange of the second lens.

7. The vehicular lamp of claim 1, wherein the upper area and the lower area are interconnected by a connecting portion to form an integrated lens.

8. The vehicular lamp of claim 7, wherein the connecting portion is formed in a flat plate shape.

9. The vehicular lamp of claim 1, wherein the second lens has upper and lower rear focal points, which are symmetric with each other about an optical axis of the first lens.

10. The vehicular lamp of claim 1, wherein light source images of focal points of the second lens formed on a rear focal plane of the first lens are projected to a front side of the lamp as reversed images.

11. The vehicular lamp of claim 1, further comprising:

a heat sink being a metal block, and configured to support the first and second light sources, the heat sink including a heat radiation pin formed on a rear surface thereof so as to radiate heat from the first and second light sources into a space in a lamp chamber.

12. The vehicular lamp of claim 11, wherein the first light source is positioned behind a focal point in correspondence with the upper area, and fixed to a top surface of the heat sink with a light emitting surface facing upward, and the second light source including a plurality of light emitting diodes, the plurality of light emitting diodes being arranged on left and right sides of a focal point at equal intervals in correspondence with the lower area, and fixed to a front surface of the heat sink with light emitting surfaces facing forward.

13. The vehicular lamp of claim 1, wherein the upper area has a convex front surface that has a vertically and transversely continuous curvatures such that an upper end of the upper area becomes the thickest, the lower area has a convex front surface that has a vertically and transversely continuous curvature such that a lower end of the lower area becomes the thickest, and each of the upper area and the lower area also has a flat rear surface.

* * * * *